US006658899B2

(12) United States Patent
Okamoto

(10) Patent No.: US 6,658,899 B2
(45) Date of Patent: Dec. 9, 2003

(54) METHOD OF KNITTING NECK OF KNIT WEAR BY WEFT KNITTING MACHINE AND THE KNIT WEAR

(75) Inventor: Kazuyoshi Okamoto, Gose (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/220,044

(22) PCT Filed: Feb. 26, 2001

(86) PCT No.: PCT/JP01/01141

§ 371 (c)(1),
(2), (4) Date: Aug. 27, 2002

(87) PCT Pub. No.: WO01/64987

PCT Pub. Date: Sep. 7, 2001

(65) Prior Publication Data

US 2003/0019249 A1 Jan. 30, 2003

(30) Foreign Application Priority Data

Feb. 29, 2000 (JP) ..... 2000-054121

(51) Int. Cl.[7] ..... D04B 7/10
(52) U.S. Cl. ..... 66/64; 66/176
(58) Field of Search ..... 66/176, 64, 70, 66/169 R, 75.1, 69, 68, 189, 171, 170

(56) References Cited

U.S. PATENT DOCUMENTS 5,289,701 A 3/1994 Mitsumoto et al.
5,417,088 A 5/1995 Nakai
5,826,445 A * 10/1998 Okamoto ..... 66/70
5,916,272 A * 6/1999 Nonnenmacher et al. ..... 66/69
5,987,930 A 11/1999 Nakai
6,138,482 A * 10/2000 Shima et al. ..... 66/69
6,286,340 B1 * 9/2001 Yui ..... 66/70

FOREIGN PATENT DOCUMENTS

JP 3010483 12/1999

* cited by examiner

*Primary Examiner*—Danny Worrell
(74) *Attorney, Agent, or Firm*—Rothwell, Figg, Ernst & Manbeck, P.C.

(57) ABSTRACT

Portions of front sleeves 4*a,* 14*a* extending from underarms to tops of sleeve caps are joined to first portions of the front body 2*a* extending partway of their lengths extending from the underarms to the shoulders along armholes 22; wherein tops of the sleeve caps of the front sleeves 4*a,* 14*a* and a part of tops of the sleeve caps of the back sleeves 4*b,* 14*b* on the side continuous to the tops of the sleeve caps of the front sleeves 4*a,* 14*a* are joined to part of the front body extending from the first portions to the shoulders, and widening stitches are formed around the neckline 10*a* at the part of the front body extending therefrom to the shoulders; portions of the back sleeves 4*b,* 14*b* extending from the underarms to the tops of the sleeve caps are joined to portions of the back body extending from the underarms to the shoulders along armholes 22; and wherein extended portions 9*b,* 19*b* are formed in the remaining portions of the tops of the sleeve caps of the back sleeves 4*b,* 14*b* and are knitted to be continuous to the shoulder portions of the back body 2*b,* and the front body 2*a* and the back body 2*b* are joined together across the extended portions 9*b,* 19*b,* whereby a seamless knitwear comfortable to wear having a front drop formed in the neckline 10 and having a large collar width is produced.

4 Claims, 6 Drawing Sheets

METHOD OF KNITTING NECK OF KNIT WEAR BY WEFT KNITTING MACHINE AND THE KNIT WEAR

TECHNICAL FIELD

The present invention relates to a knitting method of knitting a neckline of knitwear, such as a sweater and a cardigan, and to the knitwear knitted in the knitting method.

BACKGROUND ART

The applicant previously proposed in Japanese Laid-open (Unexamined) Patent Publication No. Hei 4-214448 (U.S. equivalent is U.S. Pat. No. 5,417,088) a knitting method of knitting a knitted fabric by using a flat knitting machine wherein a neckline of a front body is widened and also a front drop is formed in the neckline. In this knitting method, the front body is so knitted as to be forked from a starting point for the neckline to be formed into a right front body and a left front body which confront each other across the neckline. In the process of the knitting, widening stitches are formed around the neckline and also the stitches of the right front body and left front body are shifted to the outside, respectively. This knitting is repeated to knit the front body from the right and left front bodies up to their shoulder portions. As a result of the neckline being formed in this manner, the number of wale of the neckline is increased and, as a result of this, not only a collar knitted subsequent thereto is widened but also the front drop is automatically formed in the neckline. When the front body thus knitted is used to produce a sweater, the knitwear comes to be fancy and stylish and so comfortable to wear that when wearing, one's head can smoothly pass through the neckline.

The method of the publication cited above is directed to a knitting technology for knitting the front body singularly as a part, not to the so-called "seamless knit" that is the knitting technology in which the front body and the back body are joined at each knitting-widthwise end thereof, to knit them into a tubular form and also are joined together at shoulder portions thereof in the process of knitting by using the flat knitting machine, to complete the knitting of knitwear, such as a vest and a sweater.

The "seamless knit" is the knitting technology for simplifying or omitting the sewing operation after the knitting process. The applicant has proposed in many applications a variety of knitting technologies on and in connection with the seamless knit so far, including Japanese Laid-open (Unexamined) Patent Publications No. Hei 2(1990)-91254, Hei 2(1990)-229248, Hei 4(1992)-209855 and Hei 4(1992)-153346.

In the seamless knit using a two-bed flat knitting machine, for examples, odd needles on the needle beds are used for a front part of a knitted fabric, such as a front body and front sleeve parts; even needles are used for a back part of the knitted fabric; and alternate needles on the front and back needle beds are used for the seamless knit. When the front part of the knitted fabric is knitted, the back part of the knitted fabric is retained on (associated with) the back needle bed. On the other hand, when the back part of the knitted fabric is knitted, the front part of the knitted fabric is associated with the front needle bed. Thus, the respective fabrics are knitted, with the front and back parts overlapping each other. As a result of this, the empty needles for transference can always be reserved for the respective parts of the knitted fabric on the opposed needle beds. Using the empty needles enables the knitting of the structure pattern, such as links, garter and rib, in which front stitches and back stitches are mixed, and also enables the stitches of the sleeves and bodies to be shifted laterally so as to be joined to each other. In contrast to this, in the seamless knit using a four-bed flat knitting machine, for example, the needles on the lower front needle bed and the upper back needle bed are used to knit the front part of the knitted fabric, and the needles on the lower back needle bed and the needles on the upper front needle bed are used to knit the back part of the knitted fabric. In the seamless knit using the four-bed flat knitting machine, when the front part of the knitted fabric is knitted, the back part of the knitted fabric is associated with the lower back needle bed. On the other hand, when the back part of the knitted fabric is knitted, the front part of the knitted fabric is associated with the lower front needle bed. As a result of this, the seamless knit using the four-bed flat knitting machine does not have the limitation that the alternate needles are used for the seamless knit, differently from the seamless knit using the two-bed flat knitting machine. The seamless knit can be provided by using a flat knitting machine of a transfer jack bed type having a transfer jack bed arranging thereon transfer jacks in line and disposed over either or both of the front and back needle beds of the two-bed flat knitting machine.

On the other hand, the stitch loop holding technique disclosed by Japanese Laid-open (Unexamined) Patent Publication No. Hei 11(1999)-43849, which is called "holding technique", is applicable to the seamless knit. The terminology, "holding", means the stitch loop holding technique using a kind of compound needle, which is called "slide needle", comprising a needle body and a slider which is formed by combining two thin metal sheets and has a tongue at a front end portion thereof. In the holding technique, the stitch as was originally retained in the hook of the needle body is held by the needle and also an additional stitch is received and held on the tongue of the slider, so that those two different stitches are separately held by the same needle. Reference is made to the publication mentioned above about the details of "the holding". Using this holding technique enables the needle from which the stitch is transferred to be used as the empty needle. If this holding technique is used to transfer the stitches back to the original empty needles after the knitting is adequately performed, even the two-bed flat knitting machine can knit the knitwear seamlessly with all needles, without any need for previous reservation of the empty needles for the transference of stitches.

However, the application of the knitting method of Japanese Laid-open (Unexamined) Patent Publication No. Hei 4(1992)-21448 previously cited to the knitwear to be knitted seamlessly is not easy when the knitwear is wanted to widen the neckline width and also form the front drop in the neckline portion. For example, when the knitwear is knitted in the form of a vest, consideration must be taken of not only the front body but also the relation with the back body which is integrally knitted in parallel with the front body to confront it. Further, in knitting a sweater, a cardigan or the like, since the sleeves are laid at each side of the bodies, further consideration must be taken, including the horizontal and vertical positions of those parts and the way of forming the neckline in the front body and of being integrally knitted with the other parts while shifting the neckline to the outside, thus requiring further complicated consideration and calculation.

It is the object of the present invention to provide knitwear, such as a sweater, knitted seamlessly so as to have a front drop formed in the neckline which is knitted to have a large knitting width so as to be stylish and comfortable to wear.

DISCLOSURE OF THE INVENTION

The present invention provides a method of knitting knitwear comprising a front part having a front body and sleeves and a back part having a back body and sleeves by using a flat knitting machine comprising at least a pair of first and second needle beds, which are extended laterally and confront each other in back and front and at least either of which can be racked laterally to transfer stitches between the needles beds, wherein the knitwear is knitted in the condition that the front part of the knitwear is associated with the first needle bed and the back part of the knitwear is associated with the second needle bed, so that the body and sleeves of the front part and the body and sleeves of the back part are joined at both knitting-widthwise ends, so as to be knitted in the form of a tubular body and wherein while the bodies and the sleeves are knitted up to underarms of the knitwear and then are joined together from the underarms to shoulders so as to be knitted into a tubular form, stitches of the both sleeves and stitches of the bodies are laid over each other in sequence so that the tubular body can gradually decreased in diameter, wherein a neckline is knitted in the following steps:

a) that from a front neckline forming starting point, from which the front body is forked into a right front body and a left front body, the right front body, a right sleeve, the back body, a left sleeve and the left front body are knitted in this order, and, then, after a yarn feeder is reversed in direction at the front neckline, to knit the left front body, the left sleeve, the back body, the right sleeve and the right front body in this order in a shuttle knitting, during which the stitches around the front neckline are sequentially put into inoperative states and simultaneously the stitches of the both sleeves are shifted toward the bodies and are laid over the stitches of the bodies one after another, so as to decrease a diameter of the tubular body;

b) that only the left front body and the right front body are knitted, during which the stitches around the front neckline are sequentially removed from the knitting so as to be put into inoperative states and also while the stitches of the back sleeves are fed from outside to the front needle bed to keep balance between the knitting widths of the front and back fabrics at sleeve portions thereof retained on the first and second needle beds, the stitches of the front sleeves are shifted toward the front body and laid over the stitches of the front body;

c) that while the knitting that the stitches around the front neckline are sequentially removed from the knitting so as to be put into inoperative states is continuously performed, the knitting of only the right front body and the left front body is performed, during which while widening stitches are formed, the stitches of the right front body and the stitches of the left front body are shifted toward the sleeves, so as to allow the stitches of the front sleeves to be laid over the stitches of the back sleeves as were fed to the first needle bed in the step b); and d) that after shoulder portions of the back body and extended portions provided on tops of sleeve caps of the back sleeves are knitted in the order of the right back sleeve, the back body and the left back sleeve, the yarn feeder is reversed in direction to knit the left back sleeve, the back body and the right back sleeve in this reverse order in the shuttle knitting, during which the fabrics at the extended portions are fed toward the back body so as to allow the stitches at side ends of the sleeves and the stitches at side ends of the back body to be laid over each other and simultaneously the stitches of the front body at side ends thereof adjacent to the sleeves are fed to the second needle bed so as to be sequentially laid over the stitches at the side ends of the sleeves, whereby the front body and the back body are joined together across the extended portions of the sleeves.

Also, the present invention provides a knitting method of knitwear having a neckline with a front drop knitted by using a flat knitting machine, the neckline is knitted in the following steps:

a) that portions of front sleeves extending from underarms to tops of sleeve caps are joined to first portions of the front body extending partway of their lengths extending from the underarms to the shoulders along armholes;

b) that tops of the sleeve caps of the front sleeves and a part of tops of the sleeve caps of the back sleeves on the side continuous to the tops of the sleeve caps of the front sleeves are joined to part of the front body extending from the first portions to the shoulders, and widening stitches are formed around the neckline at the part of the front body extending therefrom to the shoulders;

c) that portions of the back sleeves extending from the underarms to the tops of the sleeve caps are joined to portions of the back body extending from the underarms to the shoulders along the armholes; and d) that extended portions are formed in the remaining portions of the tops of the sleeve caps of the back sleeves and are knitted to be continuous to the shoulder portions of the back body, and the front body and the back body are joined together across the extended portions.

Also, the present invention provides knitwear having a neckline with a front drop knitted by using a flat knitting machine, wherein portions of front sleeves extending from underarms to tops of sleeve caps are joined to first portions of the front body extending partway of their lengths extending from the underarms to the shoulders along armholes; wherein tops of the sleeve caps of the front sleeves and a part of tops of the sleeve caps of the back sleeves on the side continuous to the tops of the sleeve caps of the front sleeves are joined to part of the front body extending from the first portions to the shoulders, and widening stitches are formed around the neckline at the part of the front body extending therefrom to the shoulders; portions of the back sleeves extending from the underarms to the tops of the sleeve caps are joined to portions of the back body extending from the underarms to the shoulders along the armholes; and wherein extended portions are formed in the remaining portions of the tops of the sleeve caps of the back sleeves and are knitted to be continuous to the shoulder portions of the back body, and the front body and the back body are joined together across the extended portions.

Operation of the present invention will be described below.

From the front neckline forming starting point, the front body of the knitwear knitted into the tubular body is forked into a right front body and a left front body and also is knitted by the shuttle knitting in the order of right front body—right sleeve—back body—left sleeve—left front body as if the alphabetic character "C" is drawn. Also, when the knitting is returned at the neckline, the stitches around the neckline are sequentially put into inoperative states. As a result of this, a circular front drop is formed in the front neckline and also an aperture of the neckline is widened. In parallel with this knitting, the front sleeves and the back sleeves are shifted toward the front body and the back body, respectively, and the stitches of the sleeves and the stitches of the bodies are laid over each other one after another along the armholes, so as to decrease a diameter of the tubular body. As a result of this knitting, the portions of the front sleeves extending from the underarms to the tops of the sleeve caps are joined to portions of the front body extending partway of their lengths extending from the underarms to the shoulders along the armholes and the portions of the back sleeves extending from the underarms to the tops of the sleeve caps are joined to the portions of the back body extending partway of their lengths extending from the underarms to the shoulders along the armholes.

Then, the knitting of the back body and the sleeves is suspended, during which only the left front body and the right front body can be knitted. During this knitting, the aperture of the neckline is widened continuously and the joining of the sleeves and the bodies is collaterally performed. The joining of the sleeves and the bodies is performed in such a manner that the front body and the front sleeves are joined together, first, and, then, a part of the back sleeves are joined to the front body. During this knitting, the front sleeves retained on the first needle bed are shifted toward the front body. If this knitting proceeds, then the front sleeves and the back sleeves will be moved away from each other in the boundaries to cause possible yarn ruptures in the boundaries therebetween. To avoid this possible yarn rupture, the stitches of the back sleeves retained on the second needle bed are sequentially fed to the first needle bed from the stitch at each outside end thereof, so as to keep balance of the knitting width between the sleeves retained on the front needle bed and the sleeves retained on the back needle bed.

During the next knitting of the neckline, while the widening stitches are formed, the stitches of the right front body and the stitches of the left front body are shifted toward the sleeves and are laid over the stitches of the front sleeves retained on the first needle bed and the stitches of the back sleeves shifted one after another. As a result of this knitting, the portions of the front body extending partway of their lengths extending therefrom to the shoulders, the tops of the sleeve caps of the front sleeves and a part of the tops of the sleeve caps of the back sleeves on the side continuous to the tops of the sleeve caps of the front sleeves are joined together.

Then, the shoulder of the back body and the extended portions provided on the tops of the sleeve caps of the back sleeves undergo the shuttle knitting between the right back sleeve, the back body and the left back sleeve. During this knitting, the fabrics of the extended portions of the sleeves are shifted toward the back body so as to allow the stitches of the sleeves and the back body at side ends thereof to be laid over each other and also the stitches of the front body at side ends thereof adjacent to the extended portions of the back sleeves are shifted to the second needle bed so as to be laid over the stitches of the sleeves at side ends thereof, so as to join the front body and the back body together across the extended portions of the sleeves. Then, the collar is knitted continuously to the neckline thus formed. As a result of this, the neckline is increased in number of wale and the collar knitted continuously thereto is also increased in width, thus producing the knitwear that is so comfortable to wear that when wearing, one's head can smoothly pass through the neckline.

BEST MODE FOR CARRYING OUT THE INVENTION

In the following, a certain preferred embodiment of the present invention will be described in detail with reference to the accompanying drawings. In the illustrated embodiment, a flat knitting machine having front and back needle beds, which have a number of knitting needles arranged in line, which confront each other in front and back, with the back needle bed being capable of being racked laterally, and between which stitches are transferred, is used, though not shown.

Figure 1:
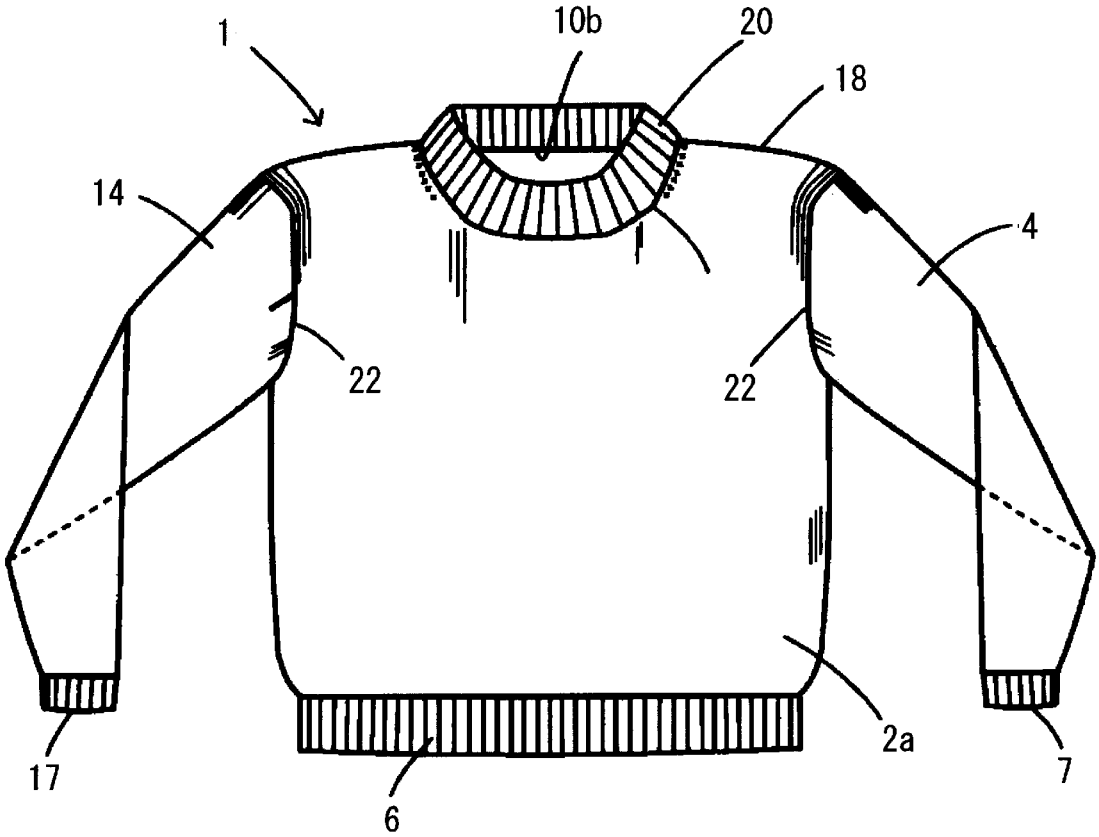
FIG. 1 shows a round-necked, set-in sweater knitted in the embodiment of the present invention.
Figure 2:
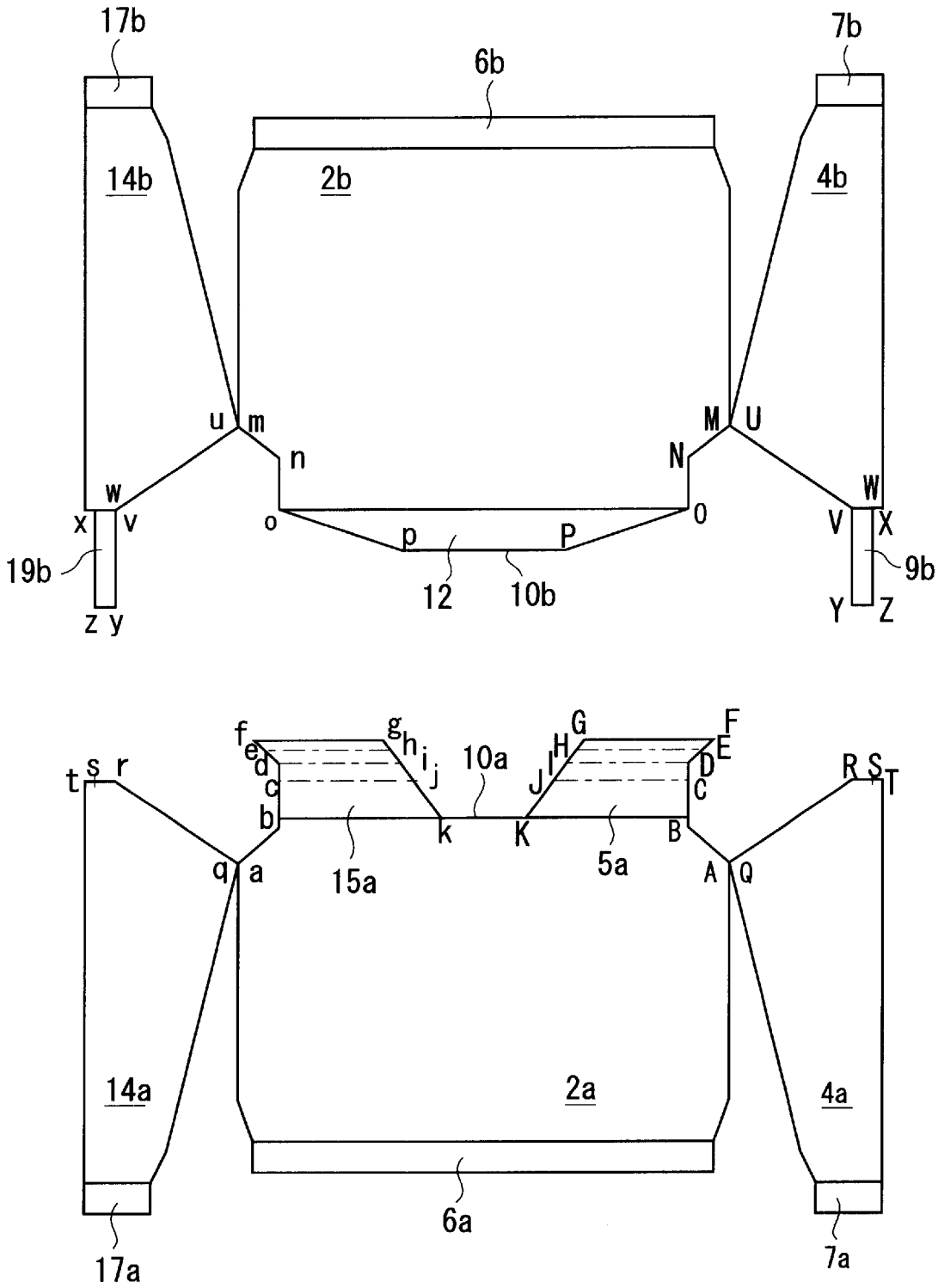
FIG. 2 shows parts of the set-in sweater that are to be knitted on a flat knitting machine.
Figure 3:
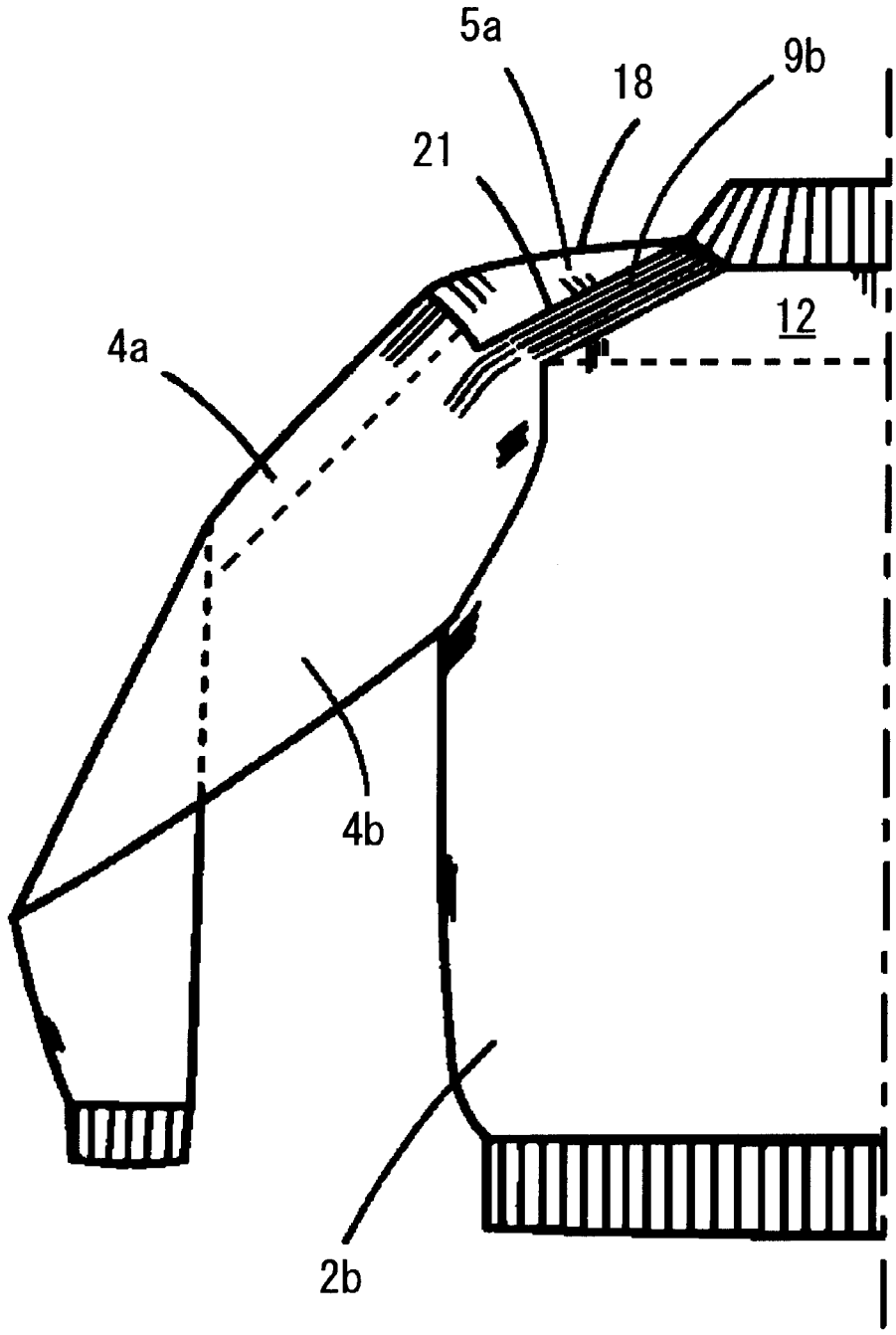
FIG. 3 shows a left half of the sweater as viewed from the back.
Figure 4:
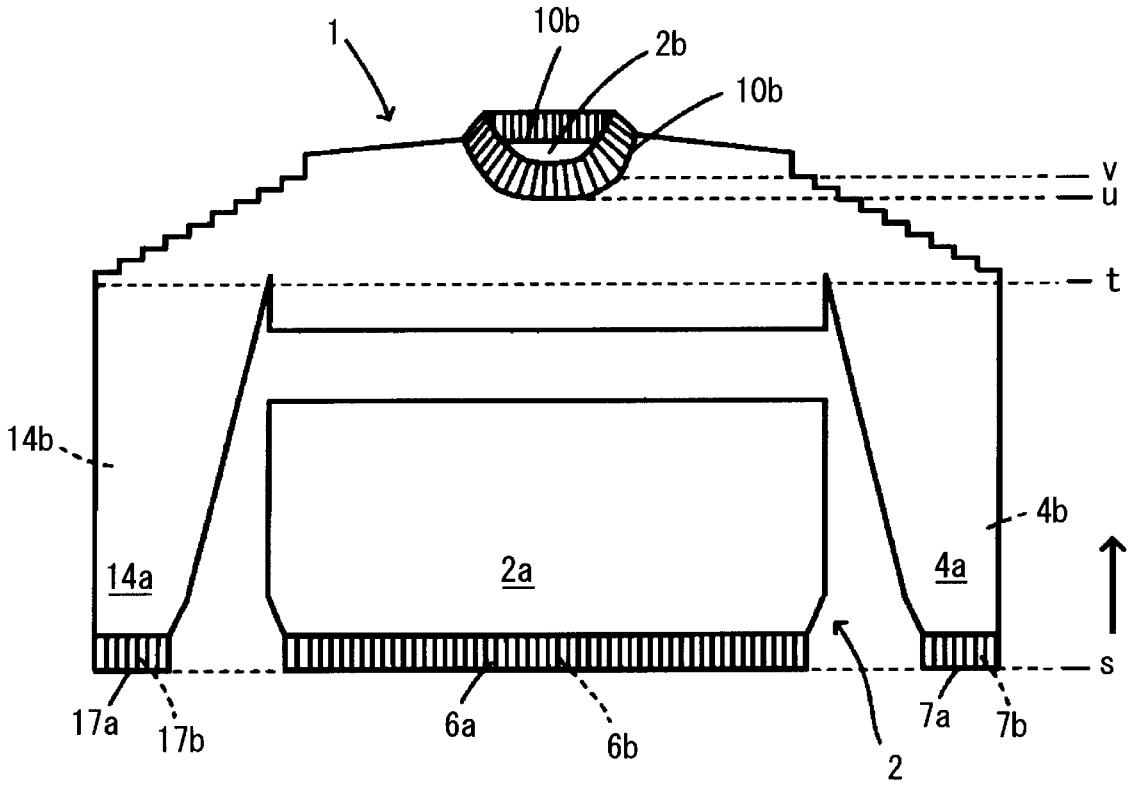
FIG. 4 shows an outline of the knitting of the sweater in the respective steps.
Figure 5:
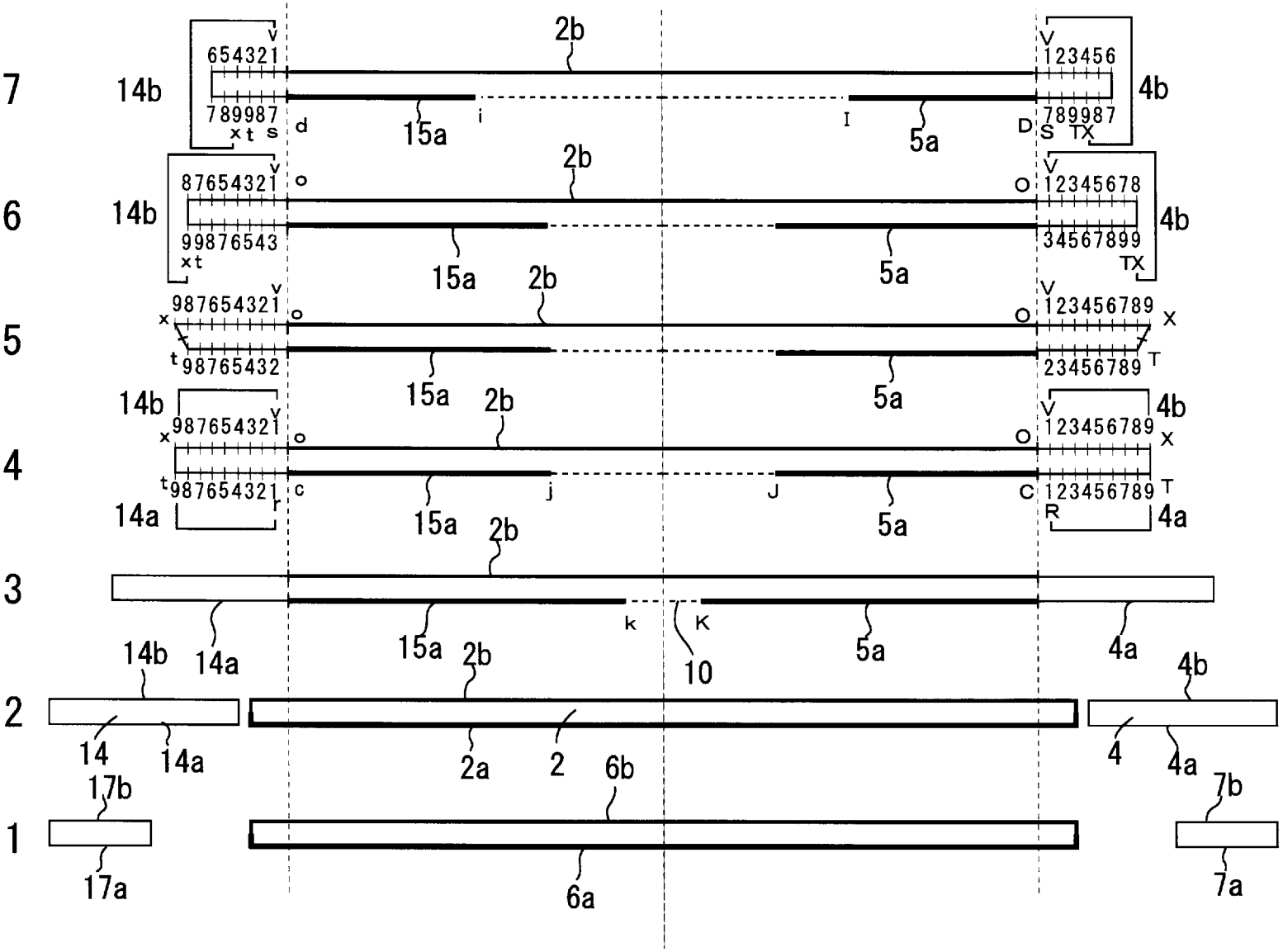
FIG. 5 shows a first half of the knitting steps of the sweater of the embodiment.
Figure 6:
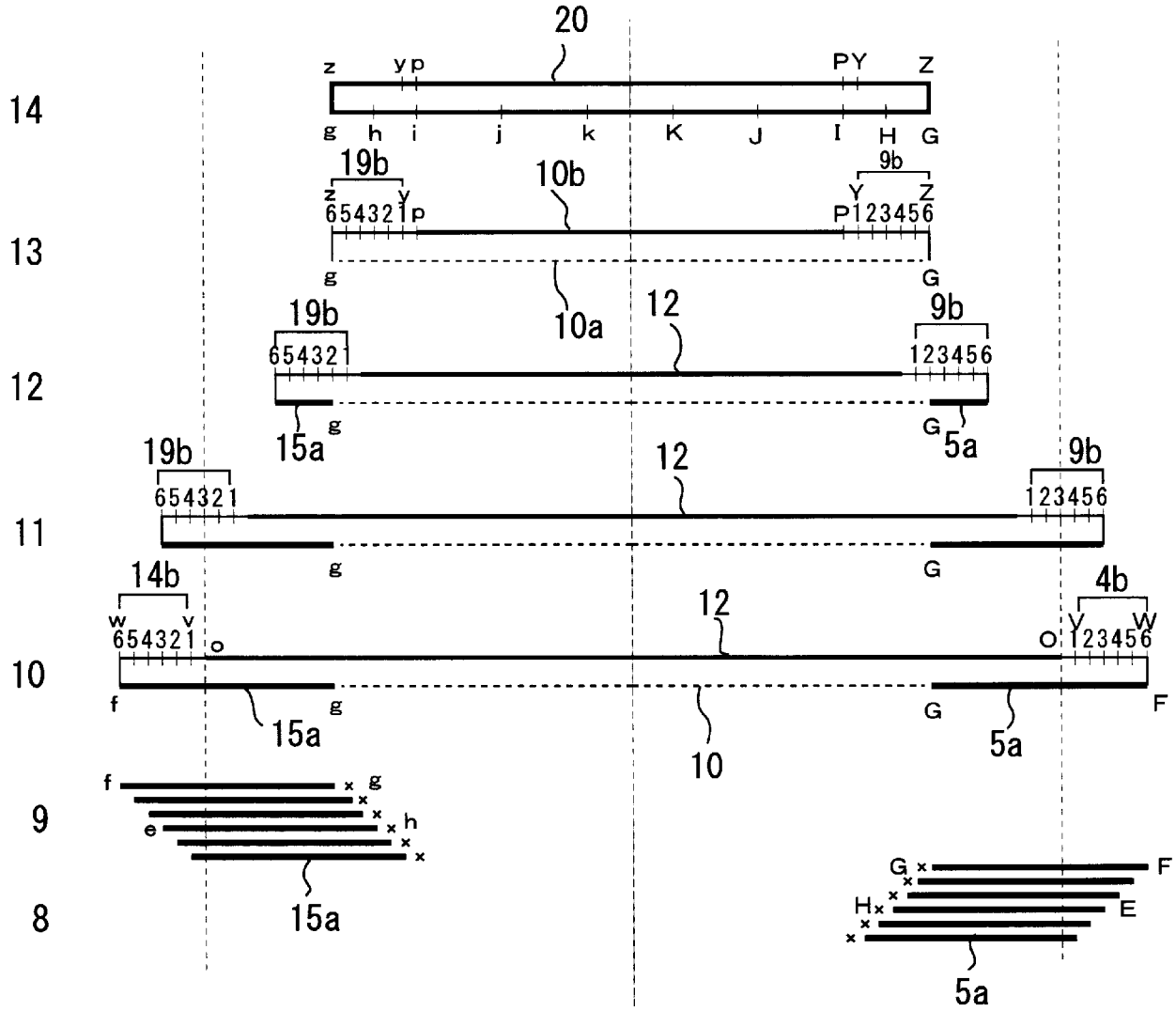
FIG. 6 shows a second half of the knitting steps of the sweater of the embodiment.

FIG. 1 shows a set-in sweater 1 knitted in this embodiment. FIG. 2 shows a pattern paper (stitch alignment) of bodies and sleeves of the sweater 1. Illustrated above is the pattern of a back body 2*b* and back sleeve parts 4*b*, 14*b* which will appear at the back side when wearing the sweater. These parts are knitted with needles on the back needle bed. Illustrated below is the pattern of a front body 2*a* and front sleeve parts 4*a*, 14*a* which will appear at the front side when wearing the sweater. These parts are knitted with needles on the front needle bed. FIG. 3 shows the left half of the sweater 1 as viewed from the back. FIG. 4 shows an outline of the knitting of the sweater 1 in the respective steps. The knitting proceeds in the direction indicated by an arrow, beginning at S. FIGS. 5 and 6 show the knitting steps, illustrating the knitting in each step of FIG. 4 in detail. In these diagrams, the front body is represented by a boldest solid line; the back body is represented by a second-boldest solid line; and the sleeves are represented in a solid line.

The sweater 1 knitted in this embodiment is a rounded-neck sweater which has the courses formed from the hem of the front body to the shoulder at the point F larger in number than the courses formed from the hem of the back body to the shoulder at O and is designed so that the front body goes beyond a shoulder line 18 into the back body and is joined to the back body thereat. For convenience of explanation, the sweater is designed in the form of an unpatterned plain knit, though it may have another structure pattern such as jacquard or rib.

As shown in FIG. 2, the front body 2*a* and the front sleeve parts 4*a*, 14*a* are joined at the underarms A, a and Q, q of the front body and the front sleeve parts, and the back body 2*b* and the back sleeve parts 4*b*, 14*b* are joined at the underarms M, m and U, u of the back body and the back sleeve parts. The line A-B-C of the front body 2*a* and the line Q-R of the sleeve 4*a* are joined together around the armhole 22, and the line a-b-c of the front body 2*a* and the line q-r of the sleeve 14*b* line are joined together around the armhole 22. Likewise, the line M-N-O of the back body 2*b* and the line U-V of the sleeve 4*b* are joined together, and the line m-n-o of the back body 2*b* and the line u-v of the sleeve 14*b* are joined together. The front body 2*a* is different from the back body 2*b* in the shape subsequent to the points K, k of the neckline 10*a* and is knitted to be forked into the right front body 15*a* and the left front body 5*b*. The line R-S of the left front sleeve 4*a* is joined to the line C-D of the left front body 5*a*, first, and, then, the line r-s of the left front sleeve 14*a* is joined to the line c-d of the left front body 15*a*. Then, the line S-T of the left front sleeve 4*a* is joined to the line D-E of the left front body 5*a,* and the line X-W of the left back sleeve 4*b* is joined to the next line E-F. Likewise, the line s-t of the right front sleeve 14*a* is joined to the line d-e of the right front body 15*a,* first, and, then, the line x-w of the right back sleeve 14*b* is joined to the next line e-f. The line F-G of the front body 2*a* and the line W-Z of the left back sleeve 4*b* are joined together at the shoulder, and the line O-P of the back body 2*b* and the line V-Y of the left back sleeve 4*b* are joined together at the shoulder. The line f-g of the front body 2*a* and the line w-z of the right back sleeve 14*b* are joined together and the line o-p of the back body 2*b* and the line v-y of the right back sleeve 14*b* are joined together. It is to be noted that the terms "right" and "left" appearing in the members, such as the right front body and the left sleeve, is intended to mean the right-hand part and the left-hand part when viewing from the a wearer who wears the sweater.

Then, reference will be made to the knitting steps of FIGS. 5 and 6. In the step 1, after yarns are fed to needles of a front needle bed FB by yarn feeders (not shown) prepared for the body 2 and the sleeves 4, 14, respectively, the yarn feeders are reversed in direction to feed the yarns to needles of a back needle bed BB. This knitting is repeated to start to knit rib portions 6, 7, 17 of a tubular body. In the step 2, the sleeves 4, 14 are knitted up to the underarms (at A, Q, a, q, M, U, m, u) in parallel with the knitting of the body 2, while increasing the diameters of the sleeves 4, 14.

From the underarms onward, the body 2 and the sleeves 4, 14 are united into a single tubular body by using the same yarn feeders that have been used, for example, for the knitting of the body. Whenever the course of the tubular body and sleeves is knitted, the stitches of the sleeves 4, 14 are shifted toward and laid over the body 2. This knitting is repeated to gradually reduce the diameter of the tubular body. In this knitting, the knitting width of the body is also reduced. The step 3 shows the state of the knitted fabrics retained on the needle beds when the front body 2*a* has been knitted up to the positions K, k at which the formation of the neckline 10*a* is started.

From the points K, k, the front body 2*a* is forked into a right front body 15*a* and a left front body 5*a*. From the points K, k at which the formation of the neckline 10*a* is started to the next points J, j, the front body is knitted in the order of the right front body 15*a,* the right sleeve 14, the back body 2*b,* the left sleeve 4 and the left front body 5*a*. Thereafter, the yarn feeders are reversed in direction at the neckline 10*a* to proceed with the knitting of the front body in the inverse order of the left front body 5*a,* the left sleeve 4, the back body 2*b,* the right sleeve 14 and the right front body 15*a* as if the alphabetic character "C" is drawn. This knitting is repeatedly performed. In this knitting, the so-called flechage knitting is performed, so that the stitches around the neckline 10*a* (lines K-J and k-j) are sequentially put into inoperative states.

The step 4 shows the state of the knitted fabrics retained on the needle beds when the front body 2*a* has been knitted up to the positions J, j to which the formation of the neckline 10*a* comes up. In this state, the line A-B-C of the front body 2*a* and the line Q-R of the sleeve 4*a;* the line a-b-c of the front body 2*a* and the line q-r of the sleeve 14*b;* the line M-N-O of the back body 2*b* and the line U-V of the sleeve 4*b;* and the line m-n-o of the back body 2*b* and the line u-v of the sleeve 14*b* are joined together, respectively. In this stage, the stitches of the sleeves 4, 14 arranged on the flat portions R-T, V-X, r-t and v-x at the top of their sleeve caps, i.e., nine stitches (wale) indicated by the numeric characters 1 to 9, are retained on the needle beds. These steps 1–4 corresponds to "s", "t", "u" and "v" shown in FIG. 4, respectively.

Next, the knitting steps 5–14 corresponding to the knitting steps subsequent to the step "v" of FIG. 4 will be described. From this step, the knitting of the back body 2*b* is temporarily suspended and the knitting of the front body only is performed. The steps 5–7 show the knitting of the neckline 10*a* leading up to the positions I, i. In these steps, an additional yarn feeder is added and whenever the courses of the right front body 15*a* and left front body 5*a* are knitted, the stitches of the right front sleeve 14*a* and the stitches of the left front sleeve 4*a* are shifted toward their bodies, so that the stitches of these sleeves are laid over the stitches of the front bodies at side ends thereof. This knitting is repeatedly performed in these steps. Six stitches 1–6 of nine stitches 1–9 located on the flat portions R-T and r-t of the sleeve caps of the right front sleeve 14*a* and left front sleeve 4*a* are joined to the front body at the positions I, i. The step 5 shows the state of the first stitch 1 of the stitches 1–6 being laid over the body. The step 6 shows the state of the next stitch 2 being laid over the body. If the sequent stitches 3–6 undergo the same knitting, then only the fabrics of the front sleeves 4*a,* 14*a* will be shifted toward the body, resulting in possible yarn breakage in the boundaries between T and X and between t and x, respectively. To avoid this possible yarn breakage, the stitches of the back sleeves 4*b,* 14*b* are sequentially fed to the front needle bed from the stitch 9 at each side end thereof, so as to minimize the difference in knitting width between the sleeves retained on the front needle bed and the sleeves retained on the back needle bed. The knitting step that the stitches 3–6 are laid over the front body is inserted between the step 6 and the step 7, though the illustration is omitted here.

In the illustrated embodiment, the knitting to join together the front bodies 5*a,* 15*a* and the right front sleeve 14*a* and left front sleeve 4*a* is provided collaterally, before leading up to their positions I, i of the neckline 10*a,* as shown in the steps 5–7. As a substitute for this, another knitting way may be adopted, such as the knitting that after the knitting to join together one of a pair, e.g. the right front body 15*a* and the right front sleeve 14*a,* leading up to the position i, is completed, the knitting to join together the other of the pair, i.e., the left front body 5*a* and the left front sleeve 4*a,* is provided. When the stitches of the right front sleeve 14*a* are shifted toward the right front body 15*a* in each stitch transfer, so as to be joined to the right front body 15*a,* the same stitches, particularly the stitches in the last half of the knitting process, are subjected to transfer many times and, as a result of this, there is the possibility that the yarn breakage may be incurred. To prevent this possible yarn breakage, all stitches of the right front sleeve 14*a* may be transferred to the back needle bed for a while, and, then, whenever the course knitting of the right front body 15 is provided, the back needle bed is racked rightwards to shift the right front sleeve 14*a* toward the body, so as to allow the stitches of the right front sleeve 14*a* to be laid over the right front body 15*a*. In the case of the four-bed flat knitting machine, the stitches of the right front sleeve 14*a* are transferred to the upper back needle bed. Then, when the back needle bed is racked, the stitches of the left back sleeve 4*b* are fed from outside to the front needle bed, to keep balance between the knitting width of the front fabric and the knitting width of the back fabric, so that the stitches of the left front sleeve 4*a* retained on the front needle bed and the stitches of the left back sleeve 4*b* retained on the back needle bed are kept in position, without being away from each other in the boundary therebetween. After the completion of the knitting of the one of the pair in this manner, the same knitting is provided for the left front body 5*a* and the left front sleeve 4*a*.

In the next steps 8 and 9, the knitting to increase the knitting width of the front neckline 10*a* is provided subsequent to the position I, i. This knitting is provided during the knitting of the right front body 15*a* and the left front body 5*a*. When the formation of the neckline 10 is led up to the position H, h, the line D-E of the left front body 5*a* and the line S-T of the left front sleeve 4*a* are joined together and the line d-e of the right front body 15*a* and the line s-t of the right front sleeve 14*a* are joined together. When the formation of the neckline 10 is led up to the position G, g, the line E-F of the left front body 5*a* and the line X-W of the left back sleeve 4*b* are joined together and the line e-f of the right front body 15*a* and the line x-w of the right back sleeve 14*b* are joined together. The step 8 shows the course knitting of the left front body 5*a* during which the right part of the neckline 10*a* is formed. In this step, whenever the left front body 5*a* is knitted in two courses, the stitches of the left front body 5*a* are shifted toward and laid over the stitches of the adjacent left sleeve 4 one after another. In this step, this knitting is repeated six times, so that the knitting width of the neckline 10*a* is increased six stitches (wale) at the right side. Whenever the stitches of the left front body 5*a* are transferred toward the left sleeve 14, widening stitches (marked by "x") are formed around the neckline, to prevent the margin of the neckline 10*a* from being bored. Although the widening stitches can be formed by using the widening technique such as tuck and split knit, any other techniques than the widening technique mentioned above may be used, as long as it can close up the bored portion. The step 9 shows the course knitting of the right front body 15*a* during which the left part of the neckline 10*a* is formed. This knitting is provided in the same manner as in the step 8. As a result of this, in this embodiment, the knitting width of the front neckline 10*a* is increased twelve stitches (wale) in total, six stitches for each side thereof. While in the embodiment illustrated above, the right part of the neckline is knitted in the step 8, first, and, then, the left part of the neckline is knitted in the step 9, the both parts of the neckline may be knitted collaterally.

The step 10 shows the state of the knitted fabrics retained on the needle beds when the neckline 10*a* is knitted up to the position G, g at which the knitting of the front body 2*a* is ended. In this step, the knitted fabric of the front body 2*a* forming the front neckline 10*a* therein is retained on the front needle bed, and the stitches of the back body 2*b* laying between O-o and the stitches 1–6 of the back sleeves laying between V-W and between v-w located at both sides of the back body are retained on the back needle bed.

Next, reference will be made to the knitting of the shoulder portion shown in the steps 10–13. In these steps, the temporarily suspended course knitting of the back body 2*b* is restarted and the course knitting of the shoulder portion of the back body 2*b* indicated by 12 in FIG. 2 is provided. The knitting of the shoulder portion 12 is provided in parallel with the knitting of the rectangular portions 9*b*, 19*b* extending from the sleeve caps of the right and left back sleeves 14*b*, 4*b*. This knitting is provided in the shuttle knitting using a single yarn feeder to knit shuttlewise between the right back sleeve 14*b*, the back body 12 and the left back sleeve 4*b*. In each course knitting, the knitted fabrics of the sleeves 9*b*, 19*b* are shifted toward the back body 2*b* to allow the stitches at the side ends of the sleeves and the stitches at the side ends of the back body to be overlaid with each other one by one, so as to gradually reduce the knitting width of the back body. During this knitting, the stitches of the front body 2*a* at the side end thereof adjacent to the sleeves 9*b*, 19*b* are fed to the back needle bed one after another in each case, so as to be laid over the stitches at the side ends of the sleeves 9*b*, 19*b*. As a result of this, the front body 2*a* and the back body 2*b* are joined to each other across the rectangular portions 9*b*, 19*b* of the sleeves (See. FIG. 3). Thus, the line F-G of the front body 2*a* and the line W-Z of the left back sleeve 4*b* are joined together and the line O-P of the back body 2*b* and the line V-Y of the left back sleeve 4*b* are joined together. Likewise, the line f-g of the front body 2*a* and the, line w-z of the right back sleeve 14*b* are joined together and the line o-p of the back body 2*b* and the line v-y of the right back sleeve 14*b* are joined together. The step 12 shows the state in which the diameter of the tubular body is partly reduced. The step 13 shows the state presented when the knitting proceeds further and the joining of the shoulder portion is ended. In this state, only the front neckline 10*a* is retained on the front needle bed, while on the other hand, the back neckline 10*b* and the rectangular portions 9*b*, 19*b* of the right and left back sleeves 14*b*, 4*b* are retained on the back needle bed.

In the step 14, after a desired number of courses of the collar 20 are knitted cyclically along the annulus (around the line g-h-i-j-k-K-J-I-H-G-Z-Y-P-p-y-z-g) formed by joining the dots g, h, i, j, k, K, J, I, H and G on the neckline formed in the front body 2*a*, the dots Z and Y of the left back sleeve 4*b*, the dots P and p of the back body 2*a* and the dots y and z of the right back sleeve 14*b*, the knitting of the sweater 1 is ended.

As mentioned above, as the result of widening stitches being provided when the front neckline 10*a* is formed, the knitting width of the front neckline 10*a* comes to be larger than that of the back neckline 10*b*, then causing difference in knitting width between the front and back parts. However, since the rectangular portions 9*b*, 19*b* of the right and left back sleeves 14*b*, 4*b* are knitted continuously, when the shoulder portion 12 of the back body is knitted, so that the front and back parts of the tubular body can be made to have a uniform knitting width, the fabric can be knitted in tubular form at the collar without any difficulty.

The sweater 1 knitted in this manner comes to have the front drop formed in the neckline 10 and resultantly comes to be stylish. Besides, it comes to have such a largely opened neckline that when wearing, one's head can smoothly pass through the neckline, resulting in being comfortable to wear. While in the illustrated embodiment, the collar 20 is knitted in the form of a rounded neck, it may be knitted in any desired design such as a turtle neck. Also, the neckline may be formed in U-shape.

Capabilities of Exploitation in Industry

According to the present invention, the number of wale of the neckline is increased, and as such can allow the width of the collar to increase, as mentioned above, thus producing the knitwear that is so comfortable to wear that when wearing, one's head can smoothly pass through the neckline.

What is claimed is:

1. A method of knitting knitwear, said knitwear comprising a front part having a front body and right and left front sleeves and a back part having a back body and right and left back sleeves using a flat knitting machine, said flat knitting machine comprising at least a pair of first and second needle beds, which are extended laterally and confront each other in back and front and at least either of which can be racked laterally to transfer stitches between the needle beds, wherein the front part of the knitwear is associated with the first needle bed and the back part of the knitwear is associated with the second needle bed so that the body and sleeves of the front part and the body and sleeves of the back part are joined at knitting-widthwise ends to form a tubular body and wherein the body and sleeves of the front part and the body and sleeves of the back part are knitted up to underarms of the knitwear and then are joined together from the underarms to shoulders of the knitwear, and stitches of the body and sleeves of the front part and the body and sleeves of the back part are laid over each other in sequence so that the tubular body can gradually decrease in diameter, wherein a neckline is knitted in the following steps:

a) from a front neckline forming starting point, from which the front body is forked into a right front body and a left front body, knitting the right front body, a right sleeve formed by the right front sleeve and the right rear sleeve, the back body, a left sleeve by the left front sleeve and the left rear sleeve and the left front body, respectively, and, then, after a yarn feeder is reversed in direction at the front neckline, knitting the left front body, the left sleeve, the back body, the right sleeve and the right front body, respectively, in a shuttle knitting, during which stitches around the front neckline are sequentially put into inoperative states and simultaneously the stitches of the sleeves are shifted toward the bodies and are laid over the stitches of the bodies, one after another, so as to decrease a diameter of the tubular body;

b) knitting the left front body and the right front body, during which the stitches around the front neckline are sequentially removed from the knitting so as to be put into inoperative states and also while the stitches of the back sleeves are fed from outside to the front needle bed to keep balance between the knitting widths of the front and back fabrics at sleeve portions thereof retained on the first and second needle beds, the stitches of the front sleeves are shifted toward the front body and laid over the stitches of the front body;

c) while the stitches around the front neckline are sequentially removed from the knitting so as to be put into inoperative states is continuously performed, the knitting of only the right front body and the left front body is performed, during which while widening stitches are formed, the stitches of the right front body and the stitches of the left front body are shifted toward the sleeves, so as to allow the stitches of the front bodies to be laid over the stitches of the front sleeves which then can be laid over the stitches of the back sleeves as were fed to the first needle bed in the step b); and d) after shoulder portions of the back body and extended portions provided on tops of sleeve caps of the back sleeves are knitted in the order of the right back sleeve, the back body and the left back sleeve, reversing the yarn feeder in direction to knit the left back sleeve, the back body and the right back sleeve in reverse order in shuttle knitting, during which the fabrics at the extended portions are fed toward the back body so as to allow the stitches at side ends of the sleeves and the stitches at side ends of the back body to be laid over each other and simultaneously the stitches of the front body at side ends thereof adjacent to the sleeves are fed to the second needle bed so as to be sequentially laid over the stitches at the side ends of the sleeves, whereby the front body and the back body are joined together across the extended portions of the sleeves.

2. A method of knitting knitwear, said knitwear comprising a front part having a front body, right and left front sleeves having sleeve caps, front shoulders and armpits, and a back part having a back body, right and left back sleeves having sleeve caps, back shoulders and armpits, and having a neckline with a front drop, by using a flat knitting machine, the neckline is knitted in the following steps:

a) that portions of front sleeves extending from underarms to tops of sleeve caps are joined to first portions of the front body extending partway of their lengths extending from the underarms to the shoulders along armholes;

b) that tops of the sleeve caps of the front sleeves and a part of tops of the sleeve caps of the back sleeves on the side continuous to the tops of the sleeve caps of the front sleeves are joined to part of the front body extending from the first portions to the shoulders, and widening stitches are formed around the neckline at the part of the front body extending therefrom to the shoulders;

c) that portions of the back sleeves extending from the underarms to the tops of the sleeve caps are joined to portions of the back body extending from the underarms to the shoulders along the armholes; and d) that extended portions are formed in the remaining portions of the tops of the sleeve caps of the back sleeves and are knitted to be continuous to the shoulder portions of the back body, and the front body and the back body are joined together across the extended portions.

3. A knitwear knitted by using a flat knitting machine, said knitwear comprising a front part having a front body, right and left front sleeves having sleeve caps, front shoulders and armpits, and a back part having a back body, right and left back sleeves having sleeve caps, back shoulders and armpits, and having a neckline with a front drop, wherein portions of front sleeves extending from underarms to tops of sleeve caps are joined to first portions of the front body extending partway of their lengths extending from the underarms to the shoulders along armholes; wherein tops of the sleeve caps of the front sleeves and a part of tops of the sleeve caps of the back sleeves on the side continuous to the tops of the sleeve caps of the front sleeves are joined to part of the front body extending from the first portions to the shoulders, and widening stitches are formed around the neckline at the part of the front body extending therefrom to the shoulders; portions of the back sleeves extending from the underarms to the tops of the sleeve caps are joined to portions of the back body extending from the underarms to the shoulders along the armholes; and wherein extended portions are formed in the remaining portions of the tops of the sleeve caps of the back sleeves and are knitted to be continuous to the shoulder portions of the back body, and the front body and the back body are joined together across the extended portions.

4. A method of knitting knitwear using a flat knitting machine, said knitwear comprising a front part having a front body and right and left front sleeves and a back part having a back body and right and left back sleeves, said flat knitting machine comprising at least a pair of first and second needle beds, each of which extended laterally and confront each other, at least one of said first and second needle beds can be racked laterally to transfer stitches between the needle beds, wherein the front part of the knitwear is associated with the first needle bed and the back part of the knitwear is associated with the second needle bed so that the body and sleeves of the front part and the body and sleeves of the back part are joined at knitting-widthwise ends to form a tubular body, wherein the body and sleeves of the front part and the body and sleeves of the back part are knitted up to underarms of the knitwear and then are joined together from the underarms to shoulders of the knitwear, and stitches of the body and sleeves of the front part and the body and sleeves of the back part are laid over each other in sequence so that the tubular body can gradually decrease in diameter, said method comprising the following steps:

a) knitting an order starting with the right front body, a right sleeve formed by the right front sleeve and the right rear sleeve, the back body, a left sleeve formed by the left front sleeve and the left rear sleeve, and the left front body, respectively, b) reversing a yarn feeder direction at the front neckline, c) knitting in an order starting with the left front body, the left sleeve, the back body, the right sleeve and the right front body, respectively, using shuttle knitting, during which stitches around the front neckline are sequentially put into inoperative states and simultaneously, the stitches of the sleeves are shifted toward the bodies and are laid over the stitches of the bodies, one after another, so as to decrease a diameter of the tubular body;

d) knitting exclusively the left front body and the right front body, during which a step of removing stitches around the front neckline sequentially from the knitting so as to be put into inoperative states and, while the stitches of the back sleeves are fed from outside to the front needle bed to keep balance between the knitting widths of the front and back fabrics at sleeve portions thereof retained on the first and second needle beds, shifting the stitches of the front sleeves toward the front body and laying over the stitches of the front body;

e) knitting exclusively the right front body and the left front body while the stitches around the front neckline are sequentially removed from the knitting so as to be put into inoperative states is continuously performed, during which forming widening stitches, shifting the stitches of the right front body and the stitches of the left front body toward the sleeves; and f) knitting shoulder portions of the back body and extended portions provided on tops of sleeve caps of the back sleeves in an order starting with the right back sleeve, the back body and the left back sleeve, respectively;

g) reversing the yarn feeder in direction to knit the left back sleeve, the back body and the right back sleeve; and h) knitting the left back sleeve, the back body and the right back sleeve, respectively, using shuttle knitting, during which the fabrics at the extended portions are fed toward the back body so that the stitches at side ends of the sleeves and the stitches at side ends of the back body are laid over each other and simultaneously the stitches of the front body at side ends thereof adjacent to the sleeves are fed to the second needle bed to sequentially lay over the stitches at the side ends of the sleeves, whereby the front body and the back body are joined together across the extended portions of the sleeves.

* * * * *